US010039171B1

(12) United States Patent
Li et al.

(10) Patent No.: US 10,039,171 B1
(45) Date of Patent: Jul. 31, 2018

(54) FEEDBACK CIRCUIT

(71) Applicant: MEANWELL (GUANGZHOU) ELECTRONICS CO., LTD, Guangzhou (CN)

(72) Inventors: Nan Li, Guangzhou (CN); Jian-Dong Yang, Guangzhou (CN)

(73) Assignee: MEANWELL (GUANGZHOU) ELECTRONICS CO., LTD. (CN)

( * ) Notice: Subject to any disclaimer, the term of this patent is extended or adjusted under 35 U.S.C. 154(b) by 0 days.

(21) Appl. No.: 15/680,321

(22) Filed: Aug. 18, 2017

(51) Int. Cl.
*H05B 37/02* (2006.01)
*H05B 33/08* (2006.01)

(52) U.S. Cl.
CPC ..... *H05B 33/0887* (2013.01); *H05B 33/0815* (2013.01); *H05B 33/0842* (2013.01); *H05B 33/0845* (2013.01); *H05B 33/0851* (2013.01)

(58) Field of Classification Search
CPC ..... H05B 33/0815; H05B 33/0818; H05B 33/0845; H05B 33/0851
USPC ..... 315/224, 297, 307
See application file for complete search history.

(56) References Cited

U.S. PATENT DOCUMENTS 8,643,295 B2 * 2/2014 Kamata ..... H05B 33/0818 315/206
2008/0224636 A1 * 9/2008 Melanson ..... H05B 33/0815 315/307
2008/0246413 A1 * 10/2008 Lin ..... H02M 7/523 315/276
2011/0101879 A1 * 5/2011 McNay ..... H05B 41/382 315/247
2014/0125246 A1 * 5/2014 Sasaki ..... H05B 33/0845 315/224
2015/0002044 A1 * 1/2015 Han ..... H05B 33/0815 315/223
2016/0073457 A1 * 3/2016 Nakajo ..... H05B 33/0815 315/223
2017/0188433 A1 * 6/2017 Chen ..... H05B 33/0812

* cited by examiner

*Primary Examiner* — Tung X Le

(57) ABSTRACT

The present invention particularly discloses a novel feedback circuit, mainly comprising: a signal sampling unit, a feedback unit, a signal concerting unit, and a signal adjusting unit. During the operation of the feedback circuit, a current-mode error amplifier unit is configured to output a current error signal based on a current sampling signal and a dimming signal outputted by the signal converting unit, so as to activate a PWM controlling unit to stabilize an output current of a LED driver circuit. In the meantime, a voltage-mode error amplifier unit cooperates with the PWM controlling unit to adaptively regulate an output voltage of the LED driver circuit based on a voltage sampling signal and an adjustment signal outputted by the signal adjusting unit, in order to facilitate the LED driver circuit provides a constant output power.

18 Claims, 6 Drawing Sheets

FEEDBACK CIRCUIT

BACKGROUND OF THE INVENTION

1. Field of the Invention

The present invention relates to the technology field of electronic circuits, and more particularly to a feedback circuit applied in power converters and power supply devices.

2. Description of the Prior Art

With the continuous advance of electronic sciences and technologies, various electronic devices and products have been development and widely applied in human life. Traditionally, linear power supply devices are adopted for outputting voltage or current to power corresponding electronic devices. However, owing to linear power supply devices possessing many disadvantages such as large volume and poor power conversion rate, switch mode power supply (SMPS) device is invented by Neti R. M. Rao and disclosed in U.S. Pat. No. 4,253,137.

SMPS technology is also applied for designing and manufacturing LED driver circuits. Please refer to FIG. 1, there is provided a circuit block diagram of a conventional LED driver circuit. As FIG. 1 shows, the conventional LED driver circuit 1' comprises: an electromagnetic interference (EMI) filtering unit 10' coupling to a voltage source $V_S'$, a rectifying unit 11', a power factor correction (PFC) unit 12', a power switch 13', a transformer unit 14', an output rectifying/filtering unit 15', a feedback unit 16', a pulse width modulation (PWM) controlling unit 17', and a dimming unit 19', wherein the said feedback unit 16' is constituted by an error amplifier unit 161' and a photo-coupler 162'. Moreover, engineers skilled in development and manufacture of power electronic circuits should know that the error amplifier unit 161' used in the LED driver circuit 1' commonly consists of voltage-mode error amplifier 1611' and current-mode error amplifier 1612'.

According to disclosures about a specific feedback control technique proposed by U.S. patent publication No. 2013/0127356 A1, it is able to know that the voltage-mode error amplifier 1611' and the current-mode error amplifier 1612' shown in FIG. 1 are able to receive a voltage sampling signal and a current sampling signal through a voltage sensing unit $V_{SU}'$ and a current sensing unit $C_{SU}'$, respectively. Furthermore, after receiving an error signal from a OR gate 1613' of the error amplifier unit 161' via the photo-coupler 162', the PWM controlling unit 17' correspondingly generates a PWM controlling signal to the power switch 13', so as to facilitate the LED driver circuit 1' steadily supply an output current/voltage to an LED lighting device 2' based on the periodic ON-OFF switching of the power switch 13'.

From FIG. 1, electronic engineers skilled in development and manufacture of LED driver circuit can also understand that, the current-mode error amplifier 1612' is configured to generate a current error signal to the PWM controlling unit 17' based on a dimming signal outputted by the dimming unit 19' and the current sampling signal. Similarly, the voltage-mode error amplifier 1611' is configured to generate a voltage error signal to the PWM controlling unit 17' based on the dimming signal and the voltage sampling signal. Moreover, it is worth noting that, only the current error signal or the voltage error signal for informing the PWM controlling unit 17' to reduce the output current/voltage would be outputted by the OR gate 1613'.

Clearly, based on the received dimming signal and the current/voltage sampling signal, conventional technology (i.e., the specific feedback control technique) mainly utilizes the error amplifier unit 161' constituted by the voltage-mode error amplifier 1611', the current-mode error amplifier 1612' and the OR gate 1613' to activate the PWM controlling unit 17' to stabilize the output current/voltage of the LED driver circuit 1'. However, owing to the feedback unit 16' and the PWM controlling unit 17' can only singly reduce the output current or the output voltage of the LED driver circuit 1', such feedback control technique cannot make the LED driver circuit 1' provide a constant power even if the LED driver circuit 1' is able to output a constant driving current or a constant driving voltage to the LED lighting device 2' under the domination of the specific feedback controlling mechanism.

In view of the fact that the conventional feedback control technology can make the LED driver circuit 1' output a constant driving current or a constant driving voltage but fail to stabilize the output power of the LED driver circuit 1', inventors of the present application have made great efforts to make inventive research thereon and eventually provided a feedback circuit for use in power converters, power supply devices, and LED drivers.

SUMMARY OF THE INVENTION

Differing from conventional feedback controlling circuit can only make a LED driver circuit provide a constant output current and/or a constant output current, the primary objective of the present invention is to provide a novel feedback circuit, which can not only activate a PWM controlling unit to stabilize the output current and the output voltage of the LED driver circuit, but also can facilitate the LED driver circuit provide a constant output power. This feedback circuit comprises: a signal sampling unit, a feedback unit, a signal concerting unit, and a signal adjusting unit. During the operation of the feedback circuit, a current-mode error amplifier unit is configured to output a current error signal based on a current sampling signal and a dimming signal outputted by the signal converting unit, so as to activate the PWM controlling unit to stabilize the output current of the LED driver circuit. In the meantime, a voltage-mode error amplifier unit cooperates with the PWM controlling unit to adaptively regulate the output voltage of the LED driver circuit based on a voltage sampling signal and an adjustment signal outputted by the signal adjusting unit, in order to facilitate the LED driver circuit provides a constant output power.

For achieving the primary objective of the present invention, the inventor of the present invention provides an embodiment for the feedback circuit applied in an LED power supply device; wherein the LED power supply device comprises a rectifying unit, a power switch, a transformer unit, an output rectifying/filtering unit, and a pulse width modulation (PWM) controlling unit; moreover, the feedback circuit comprises:

- a signal sampling unit, being coupled to output terminals of the LED power supply device for sensing a voltage sampling signal and a current sampling signal;
- a feedback unit, being coupled to the signal sampling unit, and comprising a current-mode error amplifier and a voltage-mode error amplifier;
- a signal converting unit, being coupled to the current-mode error amplifier and an external dimming circuit, and configured for converting a dimming control signal outputted from the dimming circuit to a dimming signal, so as to transmit the dimming signal to the current-mode error amplifier;

a signal adjusting unit, being coupled to the signal converting unit and the voltage-mode error amplifier, and used for applying a signal adjusting process to a reference signal based on the dimming signal and then outputting an adjusted reference signal to the voltage-mode error amplifier;

wherein the current-mode error amplifier is configured to output a current error signal to the PWM controlling unit based on the current sampling signal and the dimming signal, such that the PWM controlling unit correspondingly generates a first PWM signal to the power switch, so as to facilitate the LED power supply device steadily supply an output current to an external LED lighting device based on the periodic ON-OFF switching of the power switch;

wherein the voltage-mode error amplifier is configured to output a voltage error signal to the PWM controlling unit based on the voltage sampling signal and the adjusted reference signal, such that the PWM controlling unit correspondingly generates a second PWM signal to the power switch, so as to facilitate the LED power supply device provides a constant output power by adaptively regulating an output voltage of the LED power supply device with the variation of the output current.

Moreover, in order to achieve the primary objective of the present invention, the inventor of the present invention further provides another one embodiment for the feedback circuit applied in an LED power supply device; wherein the LED power supply device comprises a rectifying unit, a power switch, a transformer unit, an output rectifying/filtering unit, and a pulse width modulation (PWM) controlling unit; moreover, the feedback circuit comprises:

a signal sampling unit, being coupled to output terminals of the LED power supply device for sensing a voltage sampling signal and a current sampling signal;

a feedback unit, being coupled to the signal sampling unit, and comprising a current-mode error amplifier and a voltage-mode error amplifier;

a signal converting unit, being coupled to the current-mode error amplifier and an external dimming circuit, and configured for converting a dimming control signal outputted from the dimming circuit to a dimming signal, so as to transmit the dimming signal to the current-mode error amplifier;

a signal adjusting unit, being coupled to the signal converting unit and the voltage-mode error amplifier, and used for applying a signal adjusting process to a reference signal based on the dimming signal and then outputting an adjusted reference signal to the voltage-mode error amplifier;

wherein the current-mode error amplifier is configured to output a current error signal to the PWM controlling unit based on the current sampling signal and the dimming signal, such that the PWM controlling unit correspondingly generates a first PWM signal to the power switch, so as to facilitate the LED power supply device steadily supply an output current to an external LED lighting device based on the periodic ON-OFF switching of the power switch;

wherein the voltage-mode error amplifier is configured to output a voltage error signal to the PWM controlling unit based on the voltage sampling signal, a reference signal and the adjusted reference signal, such that the PWM controlling unit correspondingly generates a second PWM signal to the power switch, so as to facilitate the LED power supply device provides a constant output power by adaptively regulating an output voltage of the LED power supply device with the variation of the output current.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a feedback circuit for use in power converters, power supply devices, and LED drivers according to the present invention, embodiments of the present invention will be described in detail with reference to the attached drawings hereinafter.

First Embodiment

Figure 2:
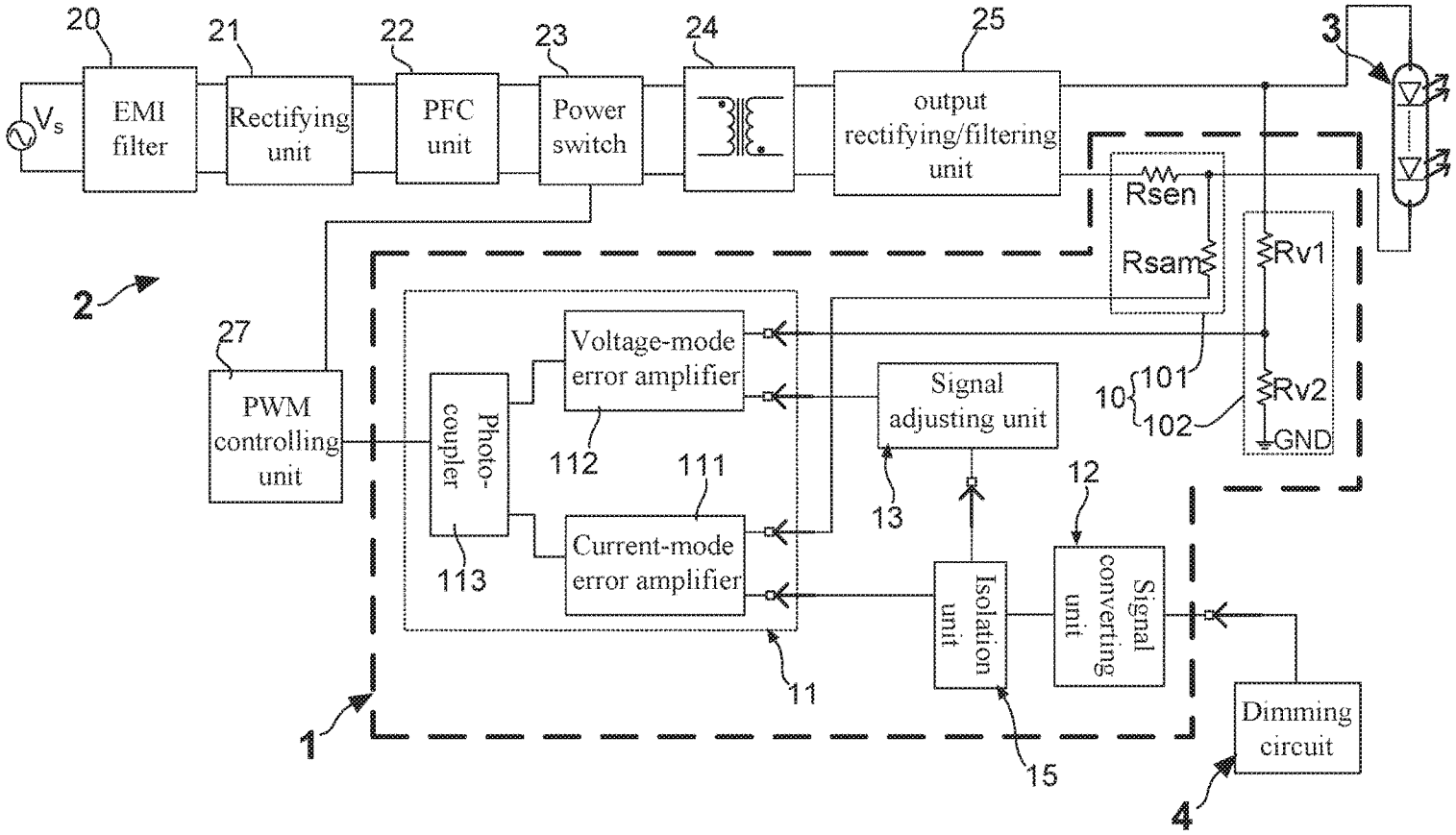
FIG. 2 shows a circuit block diagram of an LED power supply device having a feedback circuit of the present invention.

With reference to FIG. 2, there is provided a circuit block diagram of an LED power supply device having a feedback circuit of the present invention. As FIG. 2 shows, the LED power supply device 2 comprises: an electromagnetic interference (EMI) filtering unit 20 coupling to a voltage source $V_S$, a rectifying unit 21, a power factor correction (PFC) unit 22, a power switch 23, a transformer unit 24, an output rectifying/filtering unit 25, and a pulse width modulation (PWM) controlling unit 27.

Figure 3:
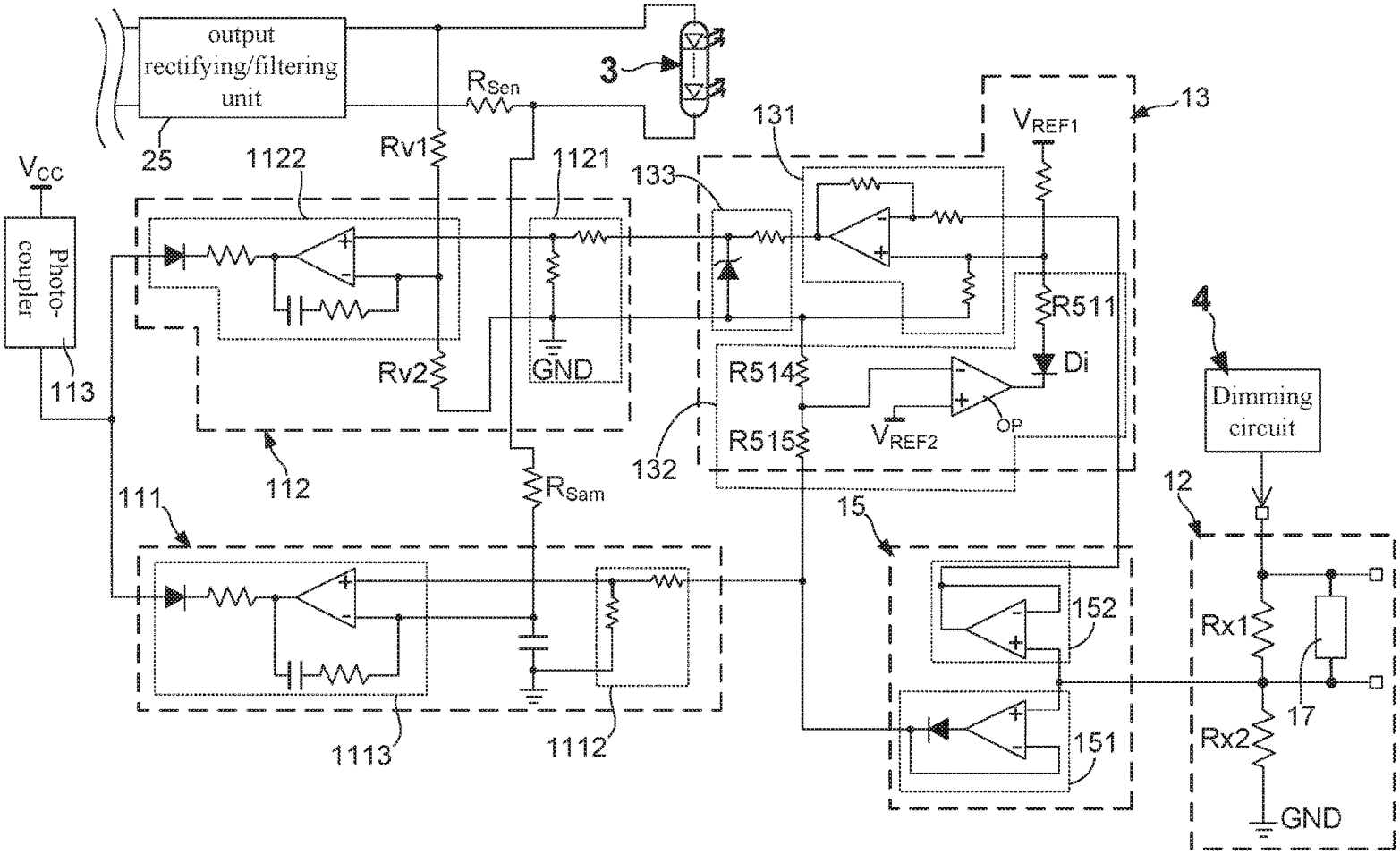
FIG. 3 shows a circuit framework view of a first embodiment of the feedback circuit.

The feedback circuit 1 of the present invention is mainly used in the LED power supply device 2 for cooperating with the PWM control unit 27 so as to stabilize the output current, the output voltage and the output power of the LED power supply device 2. Briefly speaking, this feedback circuit 1 is particularly designed to provide an assistance on facilitating the LED power supply device 2 provide constant current and/or constant voltage to an LED lighting device 3 under the maintenance of constant output power. As FIG. 2 shows, the feedback circuit 1 is constituted by a signal sampling unit 10, a feedback unit 11, a signal converting unit 12, and a signal adjusting unit 13. Moreover, FIG. 3 shows a circuit framework view of the first embodiment of the feedback circuit. From FIG. 2 and FIG. 3, it is found that the signal sampling unit 10 consists of an output current sampling unit 101 and an output voltage sampling unit 102, wherein the output current sampling unit 101 comprises a current sensing resistor Rsen and a signal sampling resistor Rsam. Moreover, the current sensing resistor Rsen is coupled to the output terminal of the LED power supply device 2 by one end thereof, and the two ends of the signal sampling resistor Rsam are coupled to the other end of the current sensing resistor Rsen and a circuit ground GND of the LED power supply device 2, respectively.

On the other hand, the output voltage sampling unit 102 comprises a first voltage dividing resistor Rv1 and a second voltage dividing resistor Rv2, wherein the first voltage dividing resistor Rv1 is coupled to the output terminal of the LED power supply device 2 by one end thereof. Moreover, the two ends of the second voltage dividing resistor Rv2 are coupled to the other end of the first voltage dividing resistor Rv1 and the circuit ground GND, respectively. Similar to conventional feedback circuits, the feedback unit 11 of this feedback circuit 1 is coupled to the signal sampling unit 10 and comprises a current-mode error amplifier 111, a voltage-mode error amplifier 112 and a photo-coupler 113. However, what is different from the conventional feedback circuits is that, the present invention particularly arranges a signal converting unit 12 to electrically connected to an external dimming circuit 4, wherein the signal converting unit 12 is configured for converting a dimming control signal outputted from the dimming circuit 4 to a dimming signal, so as to transmit the dimming signal to the current-mode error amplifier 111 and the signal adjusting unit 13. In brief, the current-mode error amplifier 111 does not be directly electrically connected to the dimming circuit 4 according to particular circuit design of the present invention. By such circuit arrangements, the current-mode error amplifier 111 is able to output a current error signal to the PWM controlling unit 27 based on the current sampling signal and the dimming signal, such that the PWM controlling unit correspondingly generates a first PWM signal to the power switch 23, so as to facilitate the LED power supply device 2 steadily supply an output current to the LED lighting device 3 based on the periodic ON-OFF switching of the power switch 23.

Moreover, as FIG. 2 and FIG. 3 show, the signal adjusting unit 13 is coupled to the signal converting unit 12 and the voltage-mode error amplifier 112, and used for applying a signal adjusting process to a reference signal based on the dimming signal generated by the signal converting unit 12, and then outputting an adjusted reference signal to the voltage-mode error amplifier. Thus, based on the voltage sampling signal and the adjusted reference signal, the voltage-mode error amplifier 112 outputs a voltage error signal for making the PWM controlling unit 27 correspondingly generates a second PWM signal to the power switch 23, so as to facilitate the LED power supply device 2 provides a constant output power by adaptively regulating an output voltage of the LED power supply device 2 with the variation of the output current. It is worth explaining that, since the present invention particularly utilizes the signal converting unit 12 to convert the said dimming control signal generated by the external dimming circuit 4 to the dimming signal, it is ensured that the signal adjusting unit and the current-mode error amplifier 111 can receive the same dimming signal, such that signal distortion or transmission error can be prevented from occurring between the different circuit units coupled to each other.

According to circuit diagram of FIG. 3, it is able to know that the signal converting unit 12 comprises a first signal converting resistor Rx1 and a second signal converting resistor Rx2, wherein the first signal converting resistor Rx1 is coupled to the dimming circuit 4 by one end thereof. Moreover, two ends of the second signal converting resistor Rx2 are coupled to the other end of the first signal converting resistor Rx1 and the circuit ground GND of the LED power supply device 2. It is worth noting that, a non-linear dimming unit 17, such as in-line package (DIP) switch or variable resistor, can be additionally coupled to the two ends of the first signal converting resistor Rx1 according to particular circuit design of the present invention. Thus, users can apply a non-linear dimming control to the LED lighting device 3 by operating the non-linear dimming unit 17. Herein it needs to explain that the said dimming circuit 4 can be a variable resistor dimming circuit, a DC dimming circuit (1-10 VDC), a PWM dimming circuit, a digital dimming circuit with decoding interface (DALI DIM), or a touch-type dimming circuit (TOUCH DIM); wherein any one of these dimming circuit is used for applying a linear dimming control to the LED lighting device 3 by outputting the dimming control signal to the signal converting unit 12.

It is worth explaining that, in order to prevent the dimming signal from being directly inputted into the current-mode error amplifier 111 and the signal adjusting unit 13, an isolation unit 15 is further arranged in the feedback circuit 1 for being coupled between the signal converting unit 12 and the current-mode error amplifier 111 as well as the signal adjusting unit 13. Moreover, as FIG. 3 shows, the current-mode error amplifier 111 consists of a first input buffer 1112 coupled to the isolation unit 15 and a first error amplifier 1113, wherein the first error amplifier 1113 is coupled to the signal sampling resistor Rsam and the first input buffer 1112 by its one negative input terminal and one positive input terminal, respectively. In addition, one output terminal of the first error amplifier 1113 is coupled to the photo-coupler 113.

Please continuously refer to FIG. 3, wherein the signal adjusting unit 13 comprises a differential amplifier 131, a voltage regulating unit 133 and a voltage comparator 132, wherein the differential amplifier 131 is coupled to the isolation unit 15 by one negative input terminal; moreover, one positive input terminal of the differential amplifier 131 is coupled to a first reference voltage $V_{REF1}$. On the other hand, the voltage comparator 132 comprises an operational amplifier OP, a first resistor R514, a second resistor R151, a diode Di, and a third resistor R515. From FIG. 3, it is found that the operational amplifier OP is coupled to a second reference voltage $V_{REF2}$ by one positive input terminal; moreover, one negative input terminal of the operational amplifier OP is coupled to the isolation unit 15 via a voltage dividing resistor set constituted by the first resistor R514 and the second resistor R515. Moreover, one output terminal of the operational amplifier OP is coupled to the positive input terminal of the differential amplifier 131 via the diode Di and the third resistor serially connected to the diode Di. In addition, the voltage regulating unit 133 is coupled to output terminal of the differential amplifier 131.

On the other hand, the voltage-mode error amplifier 112 comprises a second buffer 1121 coupled to the signal adjusting unit 13 and a second error amplifier 1122, wherein the second error amplifier 1122 is coupled to the output terminal of the differential amplifier 131 via the voltage regulating unit 133 by one positive input terminal thereof; moreover, one negative input terminal and one output terminal of the second error amplifier 1122 are coupled to the output voltage sampling unit 102 and the photo-coupler 113, respectively. Herein, it needs to further explain that, the purpose of connecting the voltage regulating unit 133 and the voltage comparator 132 to the differential amplifier 131 is to stabilize the adjusted reference signal generated by the signal adjusting unit 13, so as to cancel the signal drift effect.

Figure 4:
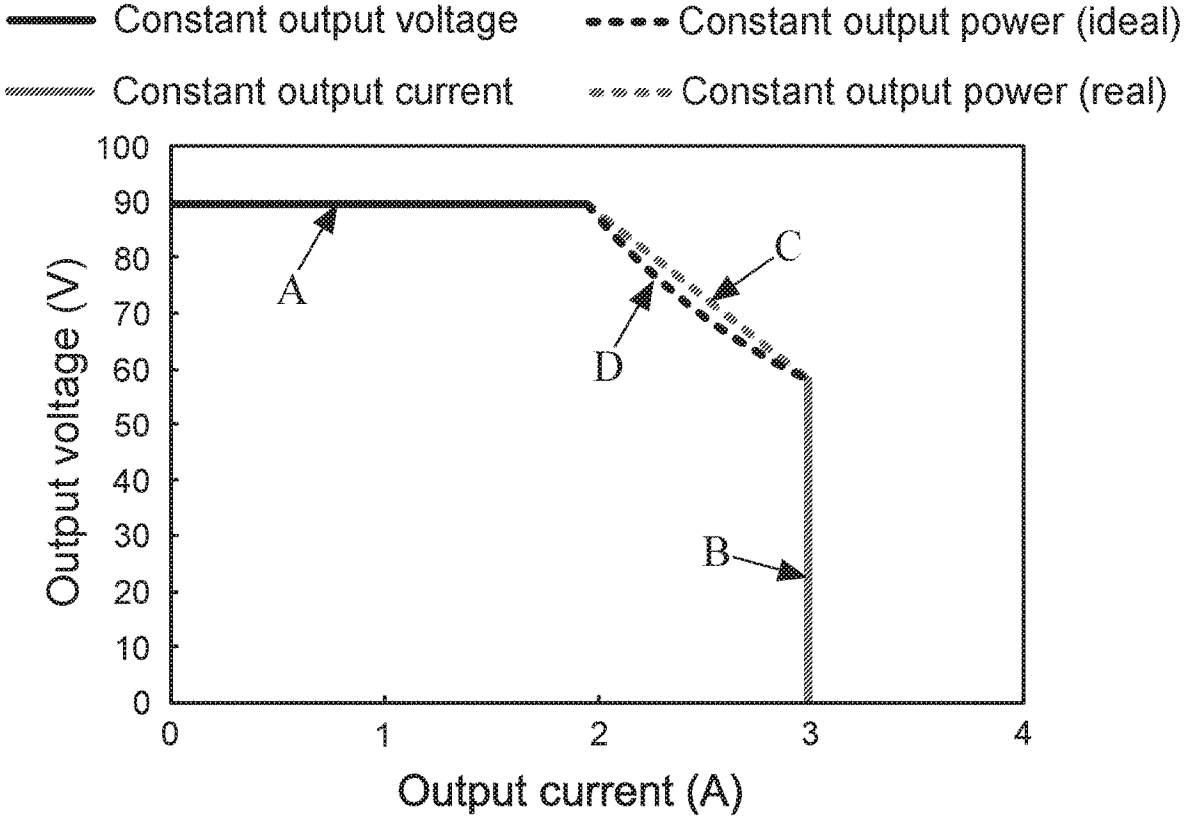
FIG. 4 shows a curve graph of output current versus output voltage.

Therefore, above descriptions have introduced the circuit framework and the constitutions of the feedback circuit 1 proposed by the present invention. Next, following paragraphs will further describe the practicability of the feedback circuit 1 under the assistance of experimental data. FIG. 4 exhibits a curve graph of output current versus output voltage, wherein related information of four curves shown in FIG. 4 are integrated in following Table (1).

TABLE 1

| Curves | Information |
|---|---|
| A | Constant output voltage provided by an LED power supply device 2 having this novel feedback circuit 1. |
| B | Constant output current provided by an LED power supply device 2 having this novel feedback circuit 1. |
| C | During the operation of the LED power supply device 2 having the novel feedback circuit 1, the current-mode error amplifier 111 activates the PWM controlling unit 27 to stabilize the output current of the LED power supply device 2. In the meantime, the voltage-mode error amplifier unit 112 cooperates with the PWM controlling unit 27 to adaptively regulate the output voltage of the LED power supply device 2 based on a voltage sampling signal and an adjustment signal, so as to facilitate the LED power supply device 2 provides a constant output power. |
| D | During the operation of the LED power supply device 2 having the novel feedback circuit 1, the current-mode error amplifier 111 activates the PWM controlling unit 27 to stabilize the output current of the LED power supply device 2. In the meantime, the voltage-mode error amplifier unit 112 cooperates with the PWM controlling unit 27 to adaptively regulate the output voltage of the LED power supply device 2 based on a voltage sampling signal and an adjustment signal, so as to facilitate the LED power supply device 2 provides a constant output power. |

It must particularly emphasize that, curve C is a real simulation data of the LED power supply device 2 having the feedback circuit 1 of the present invention; on the contrary, curve D is an ideal data. Apparently, experimental data have improved that, this novel feedback circuit 1 can indeed be helpful to facilitate the LED power supply device 2 provides constant current and/or constant voltage to an LED lighting device 3 under the maintenance of constant output power.

Second Embodiment

Figure 5:
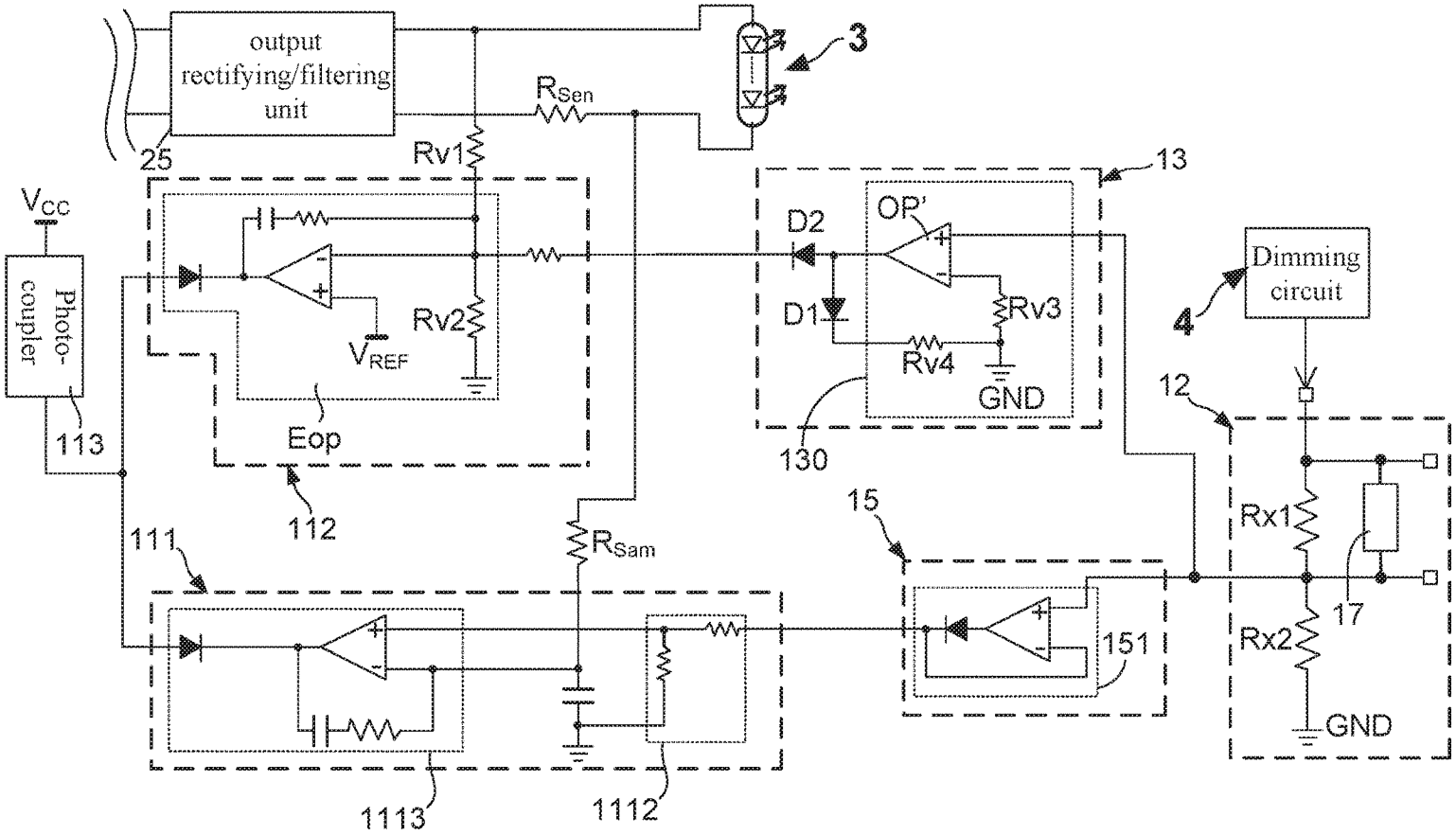
FIG. 5 shows a circuit framework view of a second embodiment of the feedback circuit.
Figure 6:
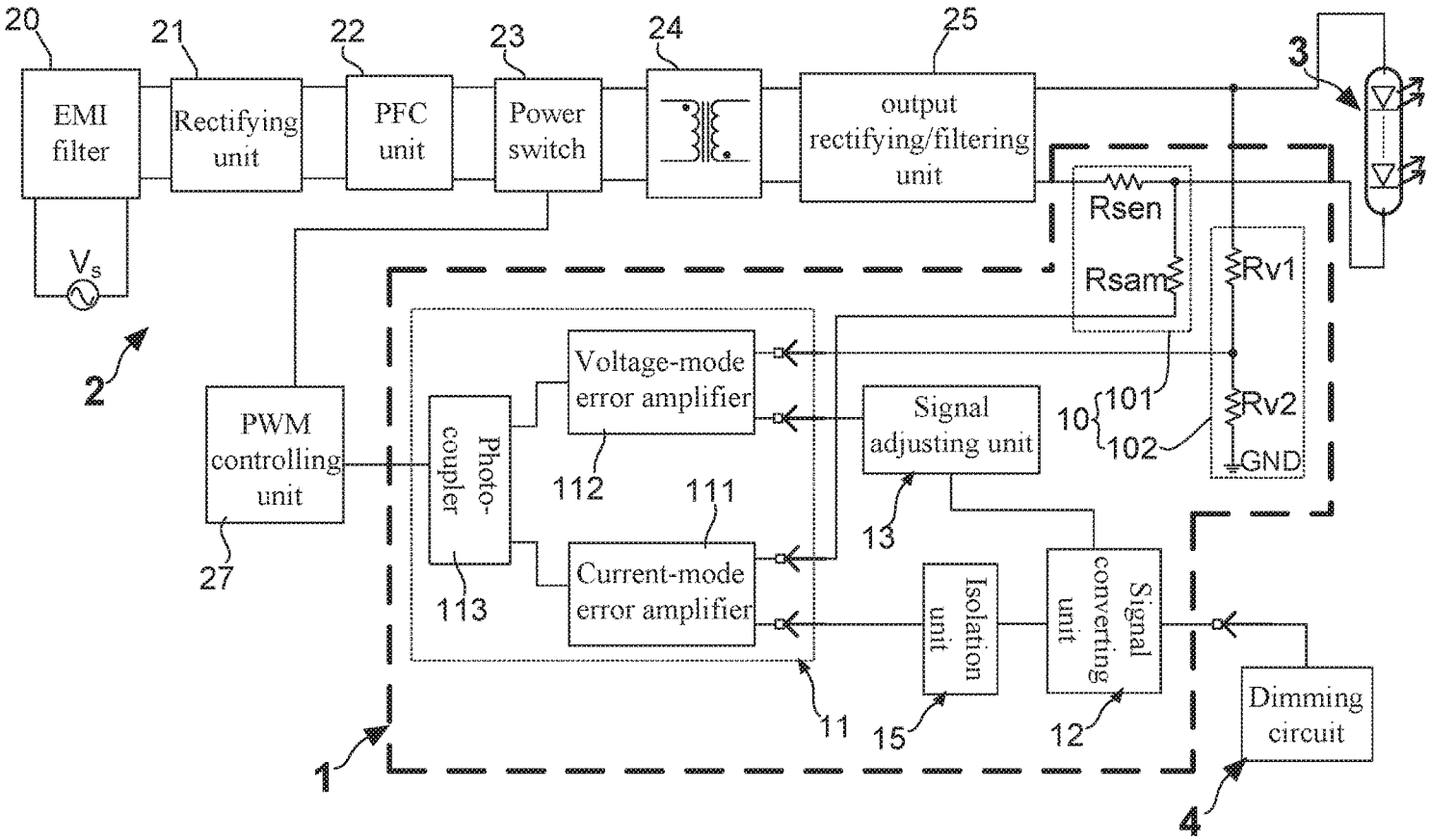
FIG. 6 shows a circuit block diagram of the LED power supply device having the feedback circuit of the present invention.

Continuously referring to FIG. 5 and FIG. 6, wherein FIG. 5 illustrates a circuit framework view of a second embodiment of the feedback circuit, and FIG. 6 shows a circuit block diagram of the LED power supply device having the feedback circuit of the present invention. After comparing FIG. 5 with FIG. 3, it can find that the second embodiment of the feedback circuit 1 comprises: a signal sampling unit 10, a feedback unit 11, a signal converting unit 12, and a signal adjusting unit 13. Moreover, differing from the signal adjusting unit 13 of the first embodiment is constituted by a differential amplifier 131, a voltage regulating unit 133 and a voltage comparator 132, the signal adjusting unit 13 of the second embodiment is an error detection unit.

From FIG. 5 and FIG. 6, it is able to know that, the signal adjusting unit 13 comprises: an operational amplifier OP', a third voltage dividing resistor Rv3, a fourth voltage dividing resistor Rv4, a first diode D1, and a second diode D2, wherein the operational amplifier OP' is coupled to the signal converting unit 12 by one positive input terminal thereof. Moreover, the third voltage dividing resistor Rv3 is coupled to one negative input terminal of the operational amplifier OP' by one end thereof, and the fourth voltage dividing resistor Rv4 is coupled to the other end of the third voltage dividing resistor Rv3. On the other hand, the first diode D1 is coupled to the other end of the fourth voltage dividing resistor Rv4 by one negative end thereof, and the positive end of the first diode D1 is coupled to one output terminal of the operational amplifier OP'. In addition, the second diode D2 is coupled to the output terminal of the operational amplifier OP' by one positive end thereof, and the negative end of the second diode D2 is coupled to the voltage-mode error amplifier 112.

Electronic engineers should know that, the operational amplifier OP', the third voltage dividing resistor Rv3 and the fourth voltage dividing resistor Rv4 form the main circuit framework of the error detector 130. Moreover, a first diode D1 and a second diode D2 are disposed between the output terminal of the operational amplifier OP' and the fourth voltage dividing resistor Rv4. By such circuit arrangement, the signal adjusting unit is able to steadily output an adjusted reference signal to the voltage-mode error amplifier 112 after applying a signal adjusting process to a reference signal $V_{REF}$ based on the dimming signal, without inducing any signal drift phenomenon. One the other hand, as FIG. 5 shows, the main circuit framework of the voltage-mode error amplifier 1112 is a an error amplifier Eop, which is configured to receive the reference signal $V_{REF}$ by one positive input terminal thereof; moreover, one negative input terminal and one output terminal of the error amplifier Eop are coupled to the signal adjusting unit 13 and the photo-coupler 113, respectively.

Figure 1:
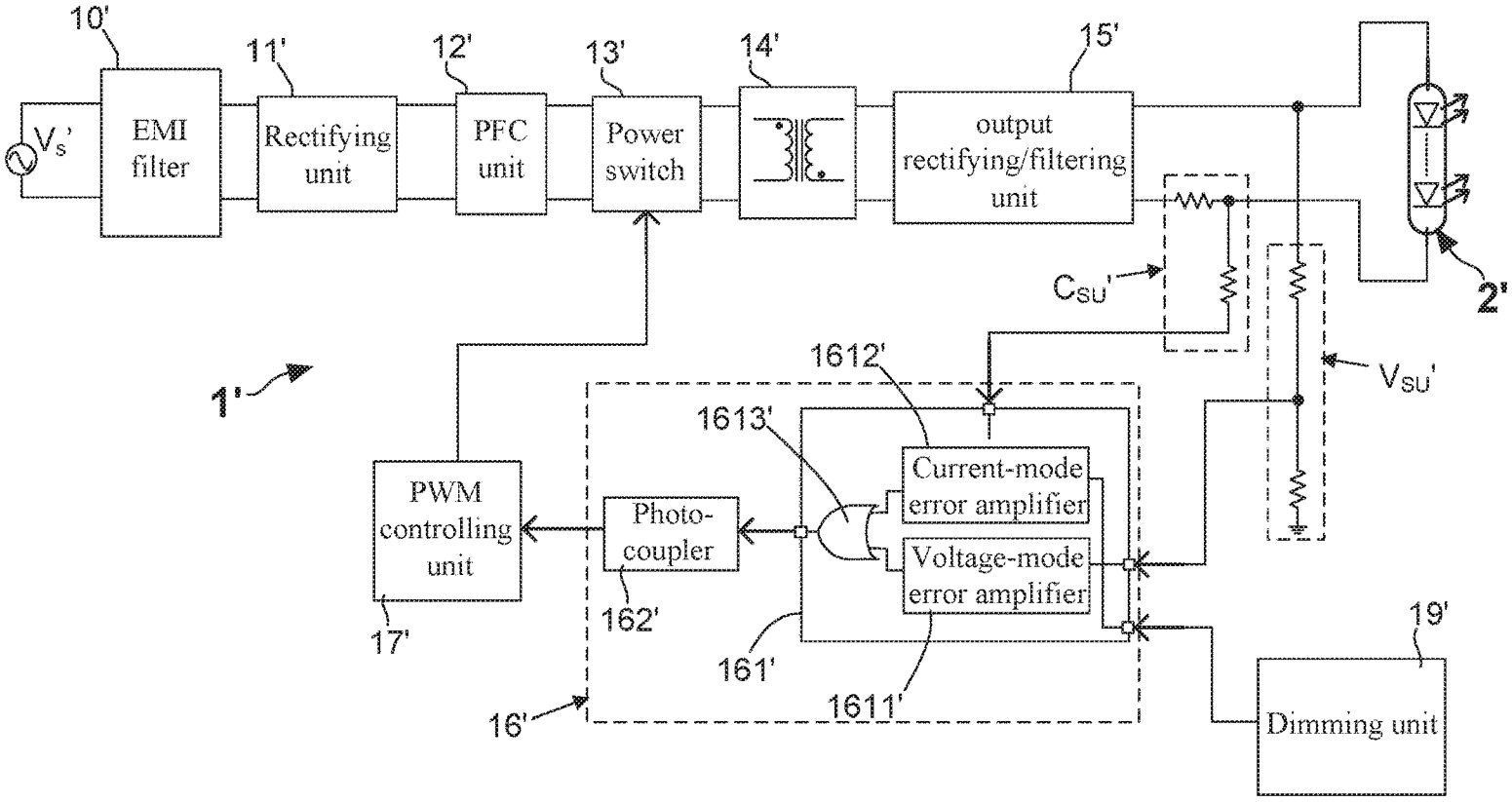
FIG. 1 (Prior Art)
FIG. 1 shows a circuit block diagram of a conventional LED driver circuit.

Therefore, through above descriptions, the feedback circuit 1 for use in power converters, power supply devices, and LED drivers proposed by the present invention have been introduced completely and clearly; in summary, the present invention includes the advantages of:

(1) Differing from conventional feedback controlling circuit (as FIG. 1 shows) can only make a LED driver circuit provide a constant output current and/or a constant output current, the present invention particularly discloses a novel feedback circuit 1, which can not only activate a PWM controlling unit 27 to stabilize the output current and the output voltage of an LED power supply device 2, but also can facilitate the LED power supply device 2 provide a constant output power. This feedback circuit 1 comprises: a signal sampling unit 10, a feedback unit 11, a signal concerting unit 12, and a signal adjusting unit 13. During the operation of the feedback circuit 1, a current-mode error amplifier unit 111 is configured to output a current error signal based on a current sampling signal and a dimming signal outputted by the signal converting unit 12, so as to activate the PWM controlling unit 27 to stabilize the output current of the LED power supply device 2. In the meantime, a voltage-mode error amplifier unit 112 cooperates with the PWM controlling unit 27 to adaptively regulate the output voltage of the LED power supply device 2 based on a voltage sampling signal and an adjustment signal outputted by the signal adjusting unit 13, so as to facilitate the LED power supply device 2 provides a constant output power.

(2) Moreover, it is worth explaining that, experimental data have improved that, this novel feedback circuit 1 can indeed be helpful to facilitate the LED power supply device 2 provides constant current and/or constant voltage to an LED lighting device 3 under the maintenance of constant output power.

The above description is made on embodiments of the present invention. However, the embodiments are not intended to limit scope of the present invention, and all equivalent implementations or alterations within the spirit of the present invention still fall within the scope of the present invention.

What is claimed is:

1. A feedback circuit for use in an LED power supply device, wherein the LED power supply device comprises a rectifying unit, a power switch, a transformer unit, an output rectifying/filtering unit, and a pulse width modulation (PWM) controlling unit, and the feedback circuit comprising:

a signal sampling unit, being coupled to output terminals of the LED power supply device for sensing a voltage sampling signal and a current sampling signal;

a feedback unit, being coupled to the signal sampling unit, and comprising a current-mode error amplifier and a voltage-mode error amplifier;

a signal converting unit, being coupled to the current-mode error amplifier and an external dimming circuit, and configured for converting a dimming control signal outputted from the dimming circuit to a dimming signal, so as to transmit the dimming signal to the current-mode error amplifier;

a signal adjusting unit, being coupled to the signal converting unit and the voltage-mode error amplifier, and used for applying a signal adjusting process to a reference signal based on the dimming signal and then outputting an adjusted reference signal to the voltage-mode error amplifier;

wherein the current-mode error amplifier is configured to output a current error signal to the PWM controlling unit based on the current sampling signal and the dimming signal, such that the PWM controlling unit correspondingly generates a first PWM signal to the power switch, so as to facilitate the LED power supply device steadily supply an output current to an external LED lighting device based on the periodic ON-OFF switching of the power switch;

wherein the voltage-mode error amplifier is configured to output a voltage error signal to the PWM controlling unit based on the voltage sampling signal and the adjusted reference signal, such that the PWM controlling unit correspondingly generates a second PWM signal to the power switch, so as to facilitate the LED power supply device provides a constant output power by adaptively regulating an output voltage of the LED power supply device with the variation of the output current.

2. The feedback circuit of claim 1, wherein the signal sampling unit comprises:

an output current sampling unit, comprising:

a current sensing resistor, being coupled to the output terminal of the LED power supply device by one end thereof; and a signal sampling resistor, being coupled to the other end of the current sensing resistor by one end thereof; such that the other end of the signal sampling resistor being coupled to a circuit ground of the LED power supply device; and an output voltage sampling unit, comprising:

a first voltage dividing resistor, being coupled to the output terminal of the LED power supply device by one end thereof; and a second voltage dividing resistor, being coupled to the other end of the first voltage dividing resistor by one end thereof; such that the other end of the second voltage dividing resistor being coupled to the circuit ground.

3. The feedback circuit of claim 2, wherein the feedback unit further comprises:

a photo-coupler, being coupled to the current-mode error amplifier, the voltage-mode error amplifier and the PWM controlling unit, used for transmitting the current error signal of the current-mode error amplifier and the voltage error signal of the voltage-mode error amplifier to the PWM controlling unit; and an isolation unit, being coupled between the signal converting unit and the current-mode error amplifier as well as the signal adjusting unit, used for preventing the dimming signal from being directly inputted into the current-mode error amplifier and the signal adjusting unit.

4. The feedback circuit of claim 3, wherein the current-mode error amplifier comprises:

a first input buffer, being coupled to the isolation unit; and a first error amplifier, being coupled to the other end of the signal sampling resistor and the first input buffer by one negative input terminal and one positive input terminal thereof; such that one output terminal of the first error amplifier being coupled to the photo-coupler.

5. The feedback circuit of claim 4, wherein the signal adjusting unit comprises:

a differential amplifier, being coupled to the isolation unit by one negative input terminal; such that one positive input terminal of the differential amplifier being coupled to a first reference voltage;

a voltage regulating unit, being coupled to one output terminal of the differential amplifier; and a voltage comparator, being coupled to a second reference voltage by one positive input terminal; such that one negative input terminal of the voltage comparator being coupled to the isolation unit via a voltage dividing resistor set, and one output terminal of the voltage comparator being coupled to the positive input terminal of the differential amplifier.

6. The feedback circuit of claim 5, wherein the voltage-mode error amplifier comprises:

a second buffer, being coupled to the signal adjusting unit; and a second error amplifier, being coupled to the output terminal of the differential amplifier via the voltage regulating unit by one positive input terminal thereof; such that one negative input terminal and one output terminal of the second error amplifier being coupled to the output voltage sampling unit and the photo-coupler, respectively.

7. The feedback circuit of claim 1, wherein the signal converting unit comprises:

a first signal converting resistor, being coupled to the dimming circuit by one end thereof;

a second signal converting resistor, being coupled to the other end of the first signal converting resistor; such that the other end of the second signal converting resistor being coupled to a circuit ground of the LED power supply device.

8. The feedback circuit of claim 7, wherein a non-linear dimming unit is configured to be additionally coupled to the two ends of the first signal converting resistor, and the said non-linear dimming unit being selected from the group consisting of: in-line package (DIP) switch or variable resistor.

9. The feedback circuit of claim 8, wherein the dimming circuit applies a linear dimming control to the LED lighting device by outputting the dimming control signal to the signal converting unit; such that a non-linear dimming control is configured to be applied to the LED lighting device by using the non-linear dimming unit.

10. A feedback circuit for use in an LED power supply device, wherein the LED power supply device comprises a rectifying unit, a power switch, a transformer unit, an output rectifying/filtering unit, and a pulse width modulation (PWM) controlling unit, and the feedback circuit comprising:

a signal sampling unit, being coupled to output terminals of the LED power supply device for sensing a voltage sampling signal and a current sampling signal;

a feedback unit, being coupled to the signal sampling unit, and comprising a current-mode error amplifier and a voltage-mode error amplifier;

a signal converting unit, being coupled to the current-mode error amplifier and an external dimming circuit, and configured for converting a dimming control signal outputted from the dimming circuit to a dimming signal, so as to transmit the dimming signal to the current-mode error amplifier; and a signal adjusting unit, being coupled to the signal converting unit and the voltage-mode error amplifier, and used for applying a signal adjusting process to a reference signal based on the dimming signal and then outputting an adjusted reference signal to the voltage-mode error amplifier;

wherein the current-mode error amplifier is configured to output a current error signal to the PWM controlling unit based on the current sampling signal and the dimming signal, such that the PWM controlling unit correspondingly generates a first PWM signal to the power switch, so as to facilitate the LED power supply device steadily supply an output current to an external LED lighting device based on the periodic ON-OFF switching of the power switch;

wherein the voltage-mode error amplifier is configured to output a voltage error signal to the PWM controlling unit based on the voltage sampling signal, a reference signal and the adjusted reference signal, such that the PWM controlling unit correspondingly generates a second PWM signal to the power switch, so as to facilitate the LED power supply device provides a constant output power by adaptively regulating an output voltage of the LED power supply device with the variation of the output current.

11. The feedback circuit of claim 10, wherein the signal sampling unit comprises:

an output current sampling unit, comprising:

a current sensing resistor, being coupled to the output terminal of the LED power supply device by one end thereof; and a signal sampling resistor, being coupled to the other end of the current sensing resistor by one end thereof; such that the other end of the signal sampling resistor being coupled to a circuit ground of the LED power supply device; and an output voltage sampling unit, comprising:

a first voltage dividing resistor, being coupled to the output terminal of the LED power supply device by one end thereof; and a second voltage dividing resistor, being coupled to the other end of the first voltage dividing resistor by one end thereof; such that the other end of the second voltage dividing resistor being coupled to the circuit ground.

12. The feedback circuit of claim 11, wherein the feedback unit further comprises:

a photo-coupler, being coupled to the current-mode error amplifier, the voltage-mode error amplifier and the PWM controlling unit, used for transmitting the current error signal of the current-mode error amplifier and the voltage error signal of the voltage-mode error amplifier to the PWM controlling unit; and an isolation unit, being coupled between the signal converting unit and the current-mode error amplifier, used for preventing the dimming signal from being directly inputted into the current-mode error amplifier.

13. The feedback circuit of claim 12, wherein the current-mode error amplifier comprises:

a first input buffer, being coupled to the isolation unit; and a first error amplifier, being respectively coupled to the other end of the signal sampling resistor and the first input buffer by one negative input terminal and one positive input terminal thereof; such that one output terminal of the first error amplifier being coupled to the photo-coupler.

14. The feedback circuit of claim 10, wherein the signal converting unit comprises:

a first signal converting resistor, being coupled to the dimming circuit by one end thereof;

a second signal converting resistor, being coupled to the other end of the first signal converting resistor; such that the other end of the second signal converting resistor being coupled to a circuit ground of the LED power supply device.

15. The feedback circuit of claim 14, wherein a non-linear dimming unit is configured to be additionally coupled to the two ends of the first signal converting resistor, and the said non-linear dimming unit being selected from the group consisting of: in-line package (DIP) switch or variable resistor.

16. The feedback circuit of claim 15, wherein the dimming circuit applies a linear dimming control to the LED lighting device by outputting the dimming control signal to the signal converting unit; such that a non-linear dimming control is configured to be applied to the LED lighting device by using the non-linear dimming unit.

17. The feedback circuit of claim 11, wherein the signal adjusting unit comprises:

an operational amplifier, being coupled to the signal converting unit by one positive input terminal thereof;

a third voltage dividing resistor, being coupled to one negative input terminal of the operational amplifier by one end thereof;

a fourth voltage dividing resistor, being coupled to the other end of the third voltage dividing resistor;

a first diode, being coupled to one output terminal of the operational amplifier by one positive end thereof; such that the negative end of the first diode being coupled to the other end of the fourth voltage dividing resistor; and a second diode, being coupled to the output terminal of the operational amplifier by one positive end thereof; such that the negative end of the second diode being coupled to the voltage-mode error amplifier.

18. The feedback circuit of claim 11, wherein the voltage-mode error amplifier comprises:

an error amplifier, receiving the reference signal by one positive input terminal thereof; such that one negative input terminal and one output terminal of the error amplifier being coupled to the signal adjusting unit and the photo-coupler, respectively.

* * * * *